US009468893B2

(12) United States Patent
Holmstrand et al.

(10) Patent No.: US 9,468,893 B2
(45) Date of Patent: Oct. 18, 2016

(54) MIXING UNIT FOR USE IN A MIXING APPARATUS AND A MIXING APPARATUS

(71) Applicant: Valmet AB, Sundsvall (SE)

(72) Inventors: Fredrik Holmstrand, Timrå (SE); Tomas Vikström, Sundsvall (SE); Jörgen Lundberg, Sundsvall (SE)

(73) Assignee: Valmet AB (SE)

( * ) Notice: Subject to any disclaimer, the term of this patent is extended or adjusted under 35 U.S.C. 154(b) by 143 days.

(21) Appl. No.: 14/365,262

(22) PCT Filed: Dec. 6, 2012

(86) PCT No.: PCT/SE2012/051350

§ 371 (c)(1),
(2) Date: Jun. 13, 2014

(87) PCT Pub. No.: WO2013/089615

PCT Pub. Date: Jun. 20, 2013

(65) Prior Publication Data

US 2014/0369156 A1 Dec. 18, 2014

(30) Foreign Application Priority Data

Dec. 15, 2011 (SE) ..... 1100924

(51) Int. Cl.
*B01F 7/02* (2006.01)
*D21C 7/06* (2006.01)
(Continued)

(52) U.S. Cl.
CPC ..... *B01F 7/02* (2013.01); *B01F 5/0451* (2013.01); *B01F 7/00808* (2013.01);
(Continued)

(58) Field of Classification Search
CPC ..... B01F 7/02; B01F 7/00808
USPC ..... 366/303, 307
See application file for complete search history.

(56) References Cited

U.S. PATENT DOCUMENTS 15,197 A * 6/1856 Schlickeysen ..... B29C 47/10 366/155.2
29,397 A * 7/1860 Park ..... A01J 25/06 366/303

(Continued)

FOREIGN PATENT DOCUMENTS

DE 29709060 U1 7/1997
WO 2004052517 A1 6/2004

OTHER PUBLICATIONS

International Search Report for Application No. PCT/SE2012/051350 dated Mar. 21, 2013.

(Continued)

*Primary Examiner* — David Sorkin
*Assistant Examiner* — Abbas Rashid
(74) *Attorney, Agent, or Firm* — Lerner, David, Littenberg, Krumholz & Mentlik, LLP

(57) ABSTRACT

A mixing unit (10) for use in a mixing apparatus (100) for mixing chemicals in liquid or gaseous state into a fiber suspension, which apparatus comprises a housing (101) defining a mixing chamber (102), a first inlet (103) for feeding a pulp suspension to the mixing chamber, a second inlet (104) for feeding treatment media into the mixing chamber, a drive shaft (105) connected to a drive device (106) for rotation of the drive shaft in operation, and an outlet (107) for discharging the mixture of pulp suspension and treatment media, said unit (10) for mixing being adapted to be installed in the mixing apparatus and comprising a rotor (11) comprising a rotor shaft (11*a*) being arranged to be connected to the drive shaft (105) for, in operation, simultaneous rotation with the drive shaft, at least two rotor bodies (11*b*, 11*c*) arranged on the rotor shaft (11*a*), each having a radial extension, the bodies being arranged to be axially separated from each other along the rotor shaft (11*a*) and adapted to cooperate so as to form multiple mixing zones. A mixing apparatus comprising the mixing unit.

12 Claims, 4 Drawing Sheets

(51) Int. Cl.

| | |
|---|---|
| ***D21C 9/00*** | (2006.01) |
| ***D21C 9/10*** | (2006.01) |
| ***B01F 5/04*** | (2006.01) |
| ***B01F 7/00*** | (2006.01) |
| ***D21F 7/00*** | (2006.01) |
| ***D21B 1/34*** | (2006.01) |

(52) U.S. Cl.

CPC ..... *D21B 1/342* (2013.01); *D21C 7/06* (2013.01); *D21C 9/00* (2013.01); *D21C 9/10* (2013.01); *D21F 7/00* (2013.01)

(56) References Cited

U.S. PATENT DOCUMENTS 1,585,169 A * 5/1926 Perkins ..... B01F 7/00158 366/303
1,670,593 A * 5/1928 Miller ..... B01F 7/00766 366/303
2,029,691 A * 2/1936 Robinson ..... B01D 11/0457 196/14.52
2,179,271 A * 11/1939 Pick ..... B01F 13/1027 366/155.1
3,940,115 A * 2/1976 Zipperer ..... B01F 7/00791 241/259.1
4,826,324 A * 5/1989 Kunz ..... B01F 15/068 366/149
4,851,571 A 7/1989 Sauer et al.
4,889,431 A * 12/1989 Liechti ..... B01F 7/048 366/149
5,823,673 A * 10/1998 Muntener ..... A23G 1/10 366/149
5,836,689 A * 11/1998 Wieland ..... D21B 1/342 366/303
2006/0013064 A1* 1/2006 Bucher ..... B01F 7/008 366/303

OTHER PUBLICATIONS

Dence, Carlton W. and Reeve, Douglas W., Pulp Bleaching, Principles and Practice, Tappi Press, Atlanta, Georgia, 1996.

* cited by examiner

MIXING UNIT FOR USE IN A MIXING APPARATUS AND A MIXING APPARATUS

CROSS-REFERENCE TO RELATED APPLICATIONS

The present application is a national phase entry under 35 U.S.C. §371 of International Application No. PCT/SE2012/051350 filed Dec. 6, 2012, published in English, which claims priority from Swedish Patent Application No. 1100924-8 filed Dec. 15, 2011, the disclosures of which are incorporated herein by reference.

TECHNICAL FIELD

The invention relates to a mixing unit for use in a mixing apparatus for mixing treatment media into a fiber suspension, e.g. a lignocellulosic pulp suspension. The invention further relates to such a mixing apparatus.

BACKGROUND

Throughout the fiberline, i.e. the different process steps involved when converting wood chips or other fibrous raw material into pulp, there are several positions where mixing apparatuses are used to mix different kind of media into the pulp suspension. The treatment media added into the fiber suspension may for example be for heating, delignification or bleaching purposes. The treatment media may be in liquid or gaseous state.

When mixing treatment media into a fiber suspension, the issue of even and homogeneous distribution is of high importance for the mixing result achieved. A well-known mixer type is disclosed in international application WO2004/052517. The mixing device described in WO2004/052517 comprises a housing with a wall defining a mixing chamber into which pulp suspension is fed by a first feeder. The device further comprises a rotor shaft with a rotor body, arranged to produce turbulence in a turbulent flow zone. A second feeder is arranged to distribute a chemical medium into or in close vicinity to the turbulent flow zone.

Although the mixing efficiency is good in the mixer disclosed above, there is still a need for an improved device with a further enhanced mixing efficiency. As the production capacity for a fiberline increases, the flow rate through the mixing apparatuses in such fiberlines increases, which leads to shorter residence times in the mixing chamber.

Accordingly, there is a need for an improved mixing unit and a mixing apparatus

SUMMARY

An object of the invention is to provide an improved unit for mixing for use in a mixing apparatus. A second object is to provide an improved mixing apparatus. These objects are achieved in accordance with the appended claims.

The invention provides a new unit for mixing for use in a mixing apparatus, the mixing unit comprising a rotor being arranged to be connected to a drive unit shaft for, in operation, simultaneous rotation with the shaft, the rotor comprising a rotor shaft and at least two rotor bodies arranged on the rotor shaft, each rotor body having a radial extension, the rotor bodies being arranged to be axially separated from each other along the rotor shaft. The rotor bodies are adapted to interact so as to form multiple mixing zones within the mixing chamber.

The mixing unit according to the current invention enables several turbulent flow zones, i.e. a prolonged mixing zone, in which the treatment media can be mixed into the fiber suspension. In that way a better mixing efficiency is achieved, ensuring that the treatment media is distributed homogeneously into the fiber suspension. The overall residence time in a mixing zone is thus increased by prolonging the mixing zone, i.e. a turbulent flow zone where mixing is achieved.

According to one embodiment, the formation of multiple mixing zones is achieved by the rotor bodies being arranged to counter-rotate. Such a counter-rotation of the rotor bodies will prevent solid body rotation of the fiber suspension and thereby enable good mixing.

In a preferred embodiment, the mixing unit comprises at least one stator body arranged to be placed between the rotor bodies in the axial direction along the rotor axis, the stator body having an extension in the radial direction, the rotor and stator bodies being adapted to interact to produce a turbulent flow in between them so as to form multiple mixing zones within the mixing chamber.

The function of the stator body placed in between the rotor bodies is to prevent the co-rotation of the fiber suspension with respect to the rotor and also to introduce a shear rate to the flow of fiber suspension and added treatment media. Such a shear rate gives rise to the turbulence and avoids a centrifugal effect, separating the normally lighter treatment media (especially when the treatment media is in the gaseous state) towards the center axis of the mixing apparatus and the fiber suspension in a radially outward direction towards the interior wall of the housing, which would occur if the stator body would be omitted. Such a centrifugal effect would result in inadequate mixing, since the treatment media in a gaseous state will separate from the fiber suspension. This effect may be more pronounced as the production volumes, and thus the flow rate of pulp suspension through a mixing apparatus, are increased.

According to an advantageous embodiment, the rotor and stator bodies have configurations enabling at least one rotor body to be introduced into and/or removed from the mixing chamber past at least one stator body. For embodiments where more than two rotor bodies are included, a respective stator body is arranged to be placed in between all of the rotor bodies of the mixing unit. A configuration according to the invention may thus include for example a first rotor body followed by a first stator body, a second rotor body followed by a second stator body and then a third and last rotor body. By ensuring that the respective configurations of the rotor and stator bodies are adapted to be able to pass each other in a longitudinal direction, an easy pull-out of the rotor is enabled, making replacement and maintenance easy. The direction of removal may be both ways in the longitudinal direction, either towards the drive unit or towards the discharge outlet. Naturally, this implies that alternatively, the stator body or bodies may be removed past the rotor bodies. In summary, the respective configuration of the rotor and stator bodies in their radial extension should be adapted to enable insertion and/or removal of a rotor or stator body by the respective bodies being adapted to be able to pass each other.

According to one embodiment, the at least one stator body is adapted to be mounted through the discharge outlet of the mixing apparatus. Such an embodiment enables an easy removal of the stator body as well, not having to dismantle the housing of the mixing apparatus.

According to yet another embodiment, the mixing unit may end with a terminal stator body, seen in a flow direction F of the fiber suspension towards the discharge outlet. In such an embodiment, the mixing unit seen in an axial direction in the flow direction of pulp suspension may comprise a first rotor body followed by a first stator body, a second rotor body and finally a second terminal stator body. It is however also possible to have additional rotor and/or stator bodies arranged before the terminal stator body. In one embodiment, the mixing unit comprises rotor and stator bodies arranged in such a way that a rotor body is always followed by a stator body. It should be noted that the rotor and stator bodies are not arranged on a common shaft but should preferably be centered around the same longitudinal center axis.

According to another embodiment, each stator body is mounted on a separate flange. Such flanges will be mounted to and at the same time constitute a part of the housing surrounding the mixing chamber. The interior of the flanges will form part of a interior wall defining the mixing chamber. In such a configuration the design of the rotor body does not have to be adapted to be able to be introduced past a stator body. Neither do the stator bodies have to be adapted for such a passing.

According to another embodiment, the stator comprises the inlet for treatment media. In such an embodiment, the treatment media may be added to the fiber suspension in a direction countercurrent to the flow of the pulp suspension on its way towards the discharge outlet. For some applications, such a countercurrent addition may improve the mixing of treatment media and fiber suspension. Moreover, when the inlet for treatment media is comprised within the stator, several distribution outlets may be provided throughout the stator which enables addition of treatment media into each individual mixing zone. Such possibilities may improve the distribution of treatment media into the fiber suspension.

According to another aspect of the invention, a mixing apparatus for mixing treatment media with fiber suspension is provided, which comprises the unit for mixing. Such a mixing apparatus may be provided with distribution pipes for treatment media to be added at a position in front of a first rotor body.

BRIEF DESCRIPTION OF THE DRAWINGS

The invention, together with further objects and advantages thereof, may best be understood by reference to the following description and appended drawings, in which.

DETAILED DESCRIPTION

Figure 1:
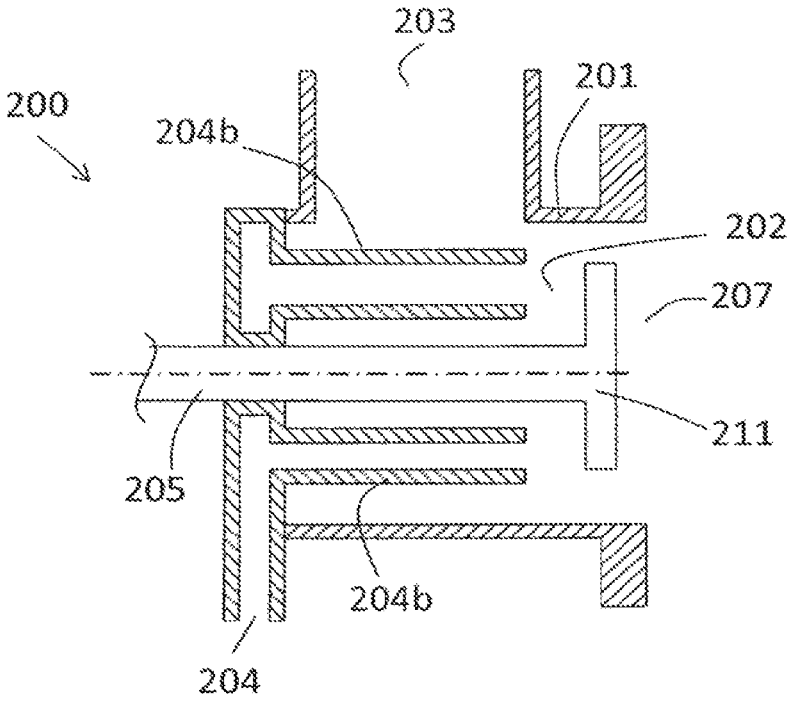
Fig. 1 PRIOR ART
FIG. 1 is a schematic cross-sectional view of a mixing chamber in a mixing apparatus according to prior art.

In the drawings, similar or corresponding elements are denoted by the same reference numbers.

FIG. 1 illustrates a mixing unit in a mixing apparatus according to prior art. The mixing apparatus 200 comprises a housing 201 defining a mixing chamber 202. The mixing apparatus further comprises a first inlet 203 for pulp suspension into the mixing chamber 202, a rotor shaft 205 comprising a rotor body 211 arranged to be rotated during operation. There is a second inlet 204 for introducing chemicals to be mixed with the pulp suspension. In operation, the rotation of the rotor body 211 will introduce a shear rate component to the flow of pulp suspension so as to create turbulence in a turbulent flow zone 208 to which the chemicals are to be added. It is the spatial velocity gradient that creates the shear rate. The chemicals are to be introduced in or in close vicinity to the turbulent flow zone 208 via distribution pipes 204*a*, 204*b*, extending in an axial direction from the second inlet 204 to a position close to the rotor body 211. In the prior art mixing apparatus the effective mixing zone is confined to an area corresponding to the turbulent flow zone created by the rotor body.

The embodiment of the invention in which two rotor bodies are arranged to be counter-rotated is not illustrated in a figure. In such an embodiment, the rotor bodies would be arranged to be able to rotate in counter-direction e.g. by means of a planetary gearing. By counter-rotating, a potential solid body rotation of the fiber suspension will be prevented. In a mixing unit where two rotor bodies are arranged on the same rotor shaft, both rotor bodies rotating in the same direction, there is a risk that the fiber suspension will experience solid body rotation, i.e. the fiber suspension rotating as a solid body. If no shear component is introduced, there will be no turbulence and thus no mixing. The counter-rotating rotor body will introduce such a shear component and thereby prevent the solid body rotation and thus enable good mixing in a prolonged mixing zone.

Figure 2:
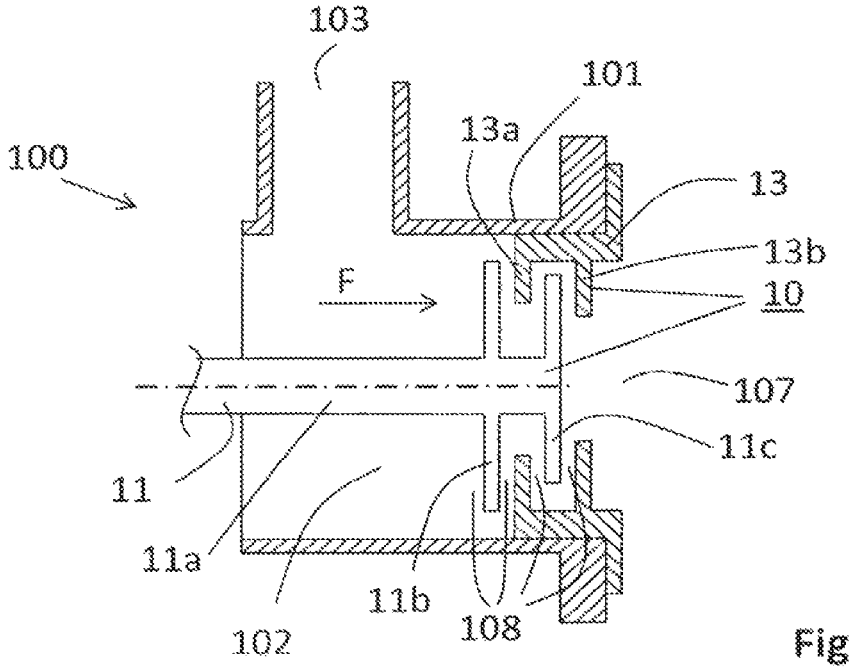
FIG. 2 is a schematic cross-sectional view illustrating a mixing apparatus with a mixing unit according to an exemplifying embodiment of the invention.

FIG. 2 illustrates an embodiment of the mixing unit and the mixing apparatus according to the invention. The mixing apparatus 100 comprises a housing 101 defining a mixing chamber 102. The mixing apparatus further comprises a first inlet 103 for introducing fiber suspension into the mixing chamber, and a second inlet 104 for introducing treatment media to be mixed with the fiber suspension (the second inlet not shown in this figure). There is also an outlet 107 for discharge of the mixed fiber suspension.

The mixing unit 10 comprises a number of parts, together as a kit forming the mixing unit. It should be noted that the word unit should not in this context be interpreted as a unit in which all parts are directly connected to each other. Nonetheless, the different parts comprised in the mixing unit are arranged to be able to cooperate with each other.

The mixing unit 10 comprises a rotor 11 and a stator 13. The rotor comprises a rotor shaft 11*a*, a first rotor body 11*b* and a second rotor body 11*c*. The extension of the first rotor body 11*b* in the radial direction is in the illustrated embodiment somewhat larger than the radial extension of the second rotor body 11*c*, the respective radial direction being defined with a starting point at the axial center of the rotor shaft and from there extending radially outwards towards the walls of the housing of the mixing apparatus 100. It should be noted that since the figure shows a cross-section of the mixing unit and apparatus according to the invention, the radial extension of the second rotor body may have an extension smaller than the one illustrated in the cross-section at other points of the circumference of the rotor body, which will be further explained in connection with FIGS. 5*a*-5*c*. It is also possible that the radial extensions of the first and second rotor bodies are essentially the same, at least at some points of the circumference of the rotor bodies for example in the manner as explained in connection with FIG. 5*c*.

The stator 13 comprises a first stator body 13*a* and a terminal stator body 13*b*, according to the embodiment illustrated in FIG. 2. The stator bodies comprise protrusions 15 extending radially inwards seen in a direction from the wall of the housing 101. The protrusions 15 may preferably be essentially evenly placed around the circumference of the stator. It should be noted that the design of the protrusions 15 is chosen to create an adequate flow restriction to the flow of fiber suspension, introducing a shear rate into the flow of fiber suspension and thus preventing the formation of a centrifugal effect in which the fiber suspension is concentrated predominantly towards the walls of the mixing chamber while the treatment media is concentrated towards the center of the mixing chamber, especially where the treatment media is in a gaseous state. When the treatment media is in liquid state, the separation may not be as pronounced as for the gaseous state, but the chemicals will nevertheless not be homogeneously distributed. A number of different designs of protrusions are encompassed within the scope of the invention. The flow restriction in connection with a rotor body thus creates a turbulent zone, in which mixing can take place.

However, for an embodiment in which the first rotor body 11*b* is to be introduced into/removed from the mixing apparatus through the discharge outlet 107, the design and configuration of the protrusions 15 of the stator body 13*a* has to be chosen with the design of the first rotor body 11*b* in mind. In case of a terminal stator body, it may in one embodiment comprise flow restrictions in the form of a number of radially inwardly extending protrusions with their inwardly pointing ends connected to an inner ring. In an embodiment in which the rotor is to be introduced into/removed from the mixing apparatus in the opposite direction, it is primarily the configuration of the second rotor body 11*c* that needs to be adapted to be able to pass the first stator body 13*a*.

Figure 3:
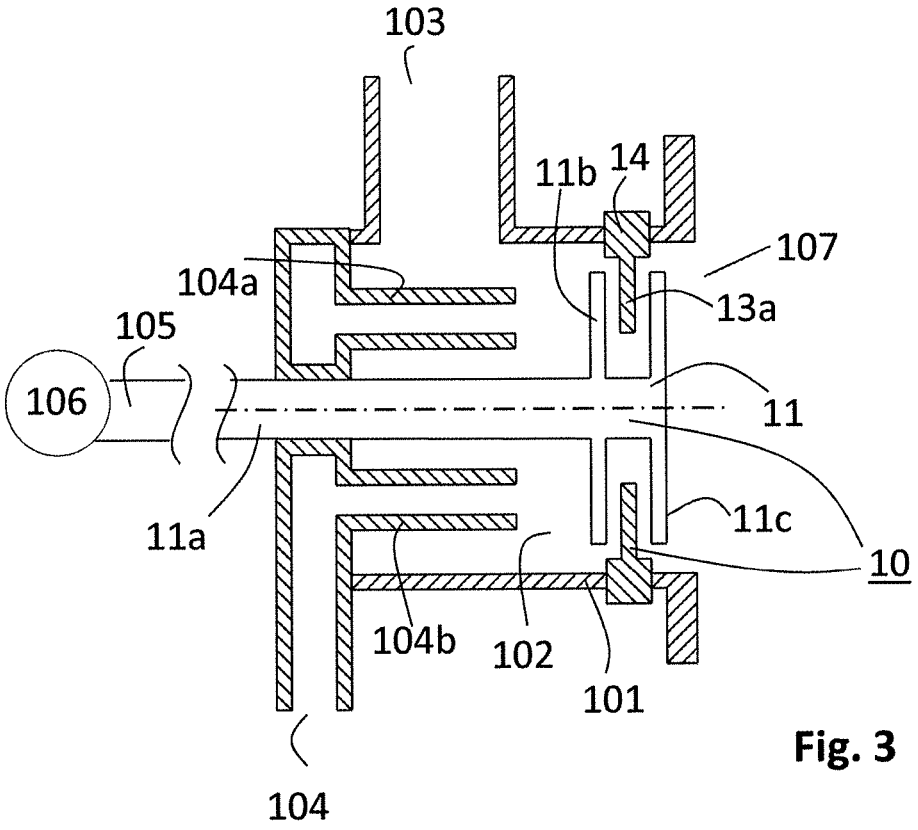
FIG. 3 is a schematic cross-sectional view illustrating a mixing unit according to an exemplifying embodiment of the invention.

The design of a possible terminal stator body must also be chosen carefully to avoid separation of treatment media, since there will be no new shear introduced by a subsequent rotor body. A wake, i.e. a stagnation point, may thus occur in connection with the terminal stator body. Since the internal diffusivity of the treatment media and the fiber suspension will be different, especially when the treatment media is in gaseous state, such a stagnation point will lead to separation of the respective media and thus poor mixing The mixing unit 10 according to the embodiment illustrated in FIG. 2, has the advantage of being easily replaceable since all parts of the mixing unit may be inserted into and/or removed through the discharge outlet opening 107. The rotor shaft will be mounted to a drive shaft 105 connected to a drive unit 106, as illustrated in FIG. 3. The rotor bodies may be attached to the rotor shaft as separate entities, but is preferably arranged to be removed together with the rotor shaft upon removal of the entire rotor. The stator may be introduced into the discharge outlet 107 and mounted to the housing 101 at the outlet. Upon removal of the entire mixing unit, the stator may first be dismantled and removed, the design of the first stator body 13*a* being adapted to be able to pass the second rotor body 11*c*. Once the stator 13 is removed, the rotor 11 may be removed by disconnecting the rotor shaft 11*a* from the drive unit shaft 105. In a preferred embodiment, the rotor is arranged to be removable despite the stator still being mounted to the housing. In such an embodiment it is necessary that the configuration of the rotor bodies and stator bodies are adapted such that the rotor bodies are able to pass the stator bodies. Some examples of such configurations are further explained in connection with FIGS. 5*a-c* and 6*a-c*.

In an alternative embodiment, it is likewise possible that the rotor 13 of the mixing unit 10 can be inserted into and/or removed from the mixing apparatus in a direction opposite to the discharge outlet, i.e. in the direction towards the drive unit. The configuration of the rotor and stator bodies may then be adapted for the rotor to be able to be removed in both directions.

The mixing unit 10 and the mixing apparatus 100 according to the invention will now be described with reference to FIG. 3, illustrating another exemplifying embodiment of the mixing unit 10 installed in a mixing apparatus 100. In the embodiment illustrated in FIG. 3, the second inlet 104 for introducing treatment media is shown and comprises at least two distribution pipes 104*a*, 104*b*, extending in an axial direction from the second inlet 104 to a position close to the rotor body 11*b*. A first stator body 13*a* is attached to the housing via a separate flange 14, the flange 14 forming a part of interior wall of the housing 101 defining the mixing chamber 102. The flange is placed in the housing 101 at a predetermined position depending on the corresponding rotor, so as to achieve a predetermined distance between the first rotor body 11*b*, the first stator body 13*a* and the second rotor body 11*c* in the axial direction. Such an embodiment has the advantage that the design of the stator body 13*a* and its protrusions 15 can be chosen more freely, not having to consider the design of the stator body 13*a* in order for the first rotor body 11*b* to pass the stator body 13*a* upon insertion into and/or removal from the mixing apparatus through the discharge outlet 107, nor in order for the second rotor body 11*c* to be able to pass in the embodiment where the rotor is to be removed backwards, i.e. in the direction towards the drive unit 106. The design and/or number of the protrusions 15 may however be impacted by other factors, for example the rotational speed of the rotor 11 and the design of the corresponding rotor body 11*b* for flow purposes, the possibility of the first rotor body 11*b* or the second rotor body 11*c* passing the first stator body 13*a* being disregarded. For a larger rotational speed, a smaller number of protrusions may be used compared to a mixing unit designed to be run at a smaller rotational speed. The "height" of the protrusions, i.e. the extension in the radial direction may also be varied. e.g. in dependence of the properties of the material flow and the desired mixing quality.

It should be noted that, although the figure only shows one stator body, several stator bodies may be arranged in between rotor bodies of the rotor. Each stator body may then be attached via a separate flange. It is also possible to combine the embodiments illustrated in FIGS. 2 and 3, having one or more stator bodies 13*a*, 13*b* on a stator inserted through the discharge outlet 107 and one or more stator bodies 13*a*, 13*b*, attached via separate flanges 14. Such an embodiment requires the housing of the mixing apparatus to be adapted for connection of the flanges of the respective stator bodies 13*a*, 13*b*. The flanges will, together with the housing, form the interior walls limiting the mixing chamber 102.

Figure 4:
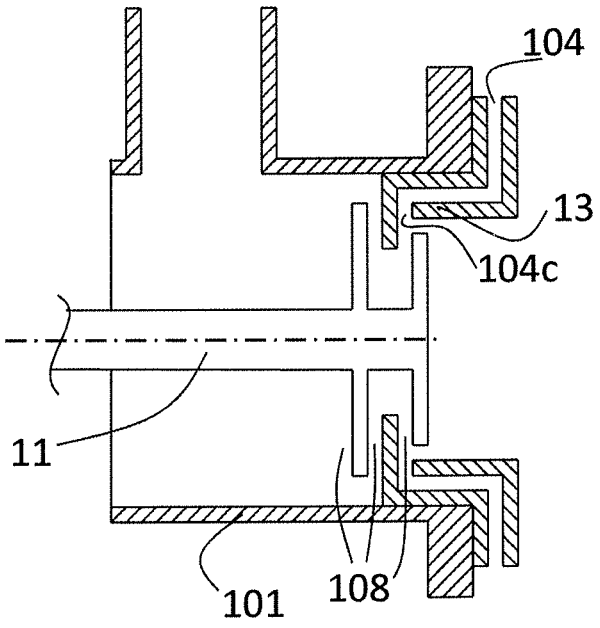
FIG. 4 is a schematic cross-sectional view illustrating a mixing unit according to an exemplifying embodiment of the invention.

According to one embodiment, illustrated in FIG. 4, the second inlet 104 for treatment media may be arranged through the stator 13. The treatment media, whether in a gaseous or liquid state may be introduced in a direction counter-current to the flow of fiber suspension, which for some applications may be advantageous from an mixing perspective. Moreover, although only one distribution outlet 104*c* is disclosed in the figure, there could be several outlets to ensure that the treatment media is efficiently distributed to the multiple mixing zones. For example, there could be additional distribution outlets leading to a zone in front of each rotor body 11*b*, 11*c*. The placement and number of the individual distribution outlets 104*c* may thus be varied within the scope of the invention, in order to achieve an improved distribution of treatment media into the fiber suspension. A possible radial extension of the individual outlets should be as small as possible in order to avoid stagnation points.

Figure 5A:
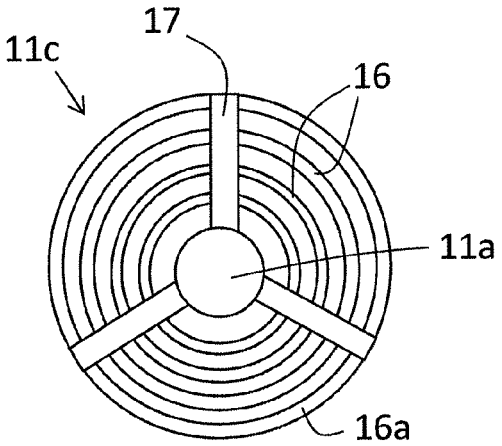
FIG. 5*a-c* illustrate possible configurations of rotor and stator bodies of the mixing unit.

FIG. 5*a* illustrates a possible embodiment of the design of the rotor bodies. The rotor body may comprise a number of concentric rings 16, connected by a number of radial rotor bars 17 extending from the rotor shaft. The configuration of the rotor body must, as previously discussed, in the embodiment where the rotor is to be introduced into and/or removed from the mixing apparatus through the discharge outlet 107 be adapted in such a way to enable the first rotor body 11*b* to pass past the first stator body 13*a*. The number of concentric rings may be reduced in order to reduce the radial extension at least around parts of the outer circumference of the rotor body. In one embodiment such a configuration is achieved by in the first rotor body 11*b* omitting the outermost ring 16*a* of the second rotor body 11*c*, so that the extension of the stator protrusions 15 end at a distance from the new outermost ring 16*b* of the first rotor body 11*b*. The rotor bars 17 may still have the same radial extension for the respective rotor bodies, provided that the stator body 13*a* to be placed in between the rotor bodies has protrusions adapted to be fit in between the rotor bars 17, which may be achieved by displacing the stator protrusions 15 around the stator circumference in such a way that they fit in the spaces between the rotor bars 17, upon insertion of the rotor through the discharge outlet 107. For an embodiment in which the rotor is to be introduced into/removed from the mixing apparatus in a direction towards the drive unit 106, the considerations above regarding the first rotor body 11*b* instead apply to the second rotor body 11*c*.

Figure 5B:
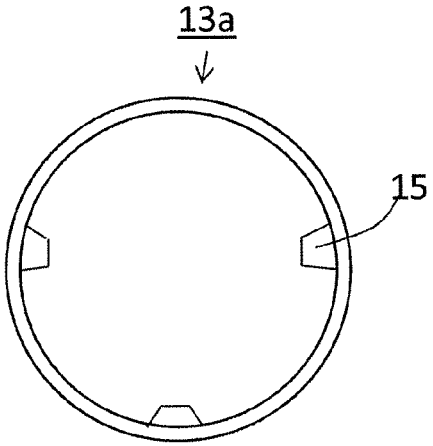

FIG. 5*b* shows an exemplifying embodiment of a first stator body 13*a*. In the figure, there are three protrusions distributed substantially evenly around the circumference of the stator 13. The number of protrusions may correspond to the number of rotor bars arranged on the rotor body, but could just as well exceed or be less in number compared to the rotor bars, as long as the design enables a rotor body to pass the stator body upon insertion into/removal from the mixing apparatus.

Figure 5C:
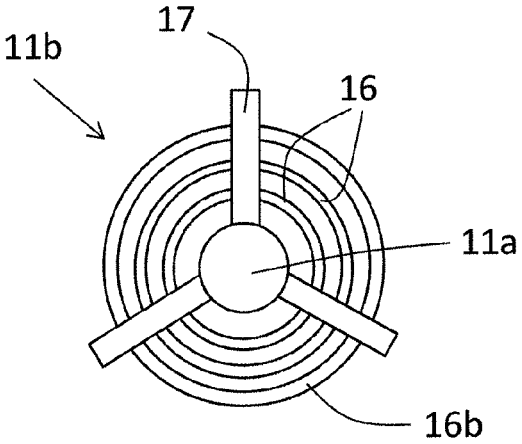

FIG. 5*c* shows an exemplifying embodiment of a first rotor body 11*b*, in which the outermost concentric ring 16*b* is at a radial distance from the rotor shaft axis which is less than the radial extension of the rotor bars 15. The radial extensions of the protrusions 15 of a corresponding first stator body may thus be adapted not to exceed the radial position of the outermost concentric ring 16*b*. In the embodiment where the rotor 13 is to be inserted into/removed from the mixing apparatus in a direction towards the drive unit 106, FIG. 5*c* could be considered an illustration of the second rotor body 11*c*.

Figure 6A:
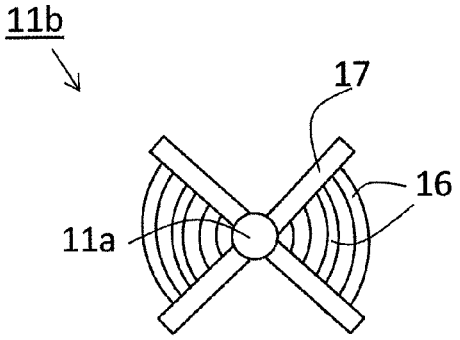
FIG. 6*a-c* illustrate possible configurations of rotor and stator bodies of the mixing unit.

FIG. 6*a* shows another possible embodiment of the rotor configuration, in which the concentric rings 16 are interrupted to form arcs between two adjacent rotor bars and then leaving an empty space between the following two rotor bars. The configuration of the rotor and stator bodies can be compared to a puzzle configuration although the pieces do not necessarily have to fit exactly to each other. The stator protrusions might have a smaller extension than corresponding exactly to the available space in between rotor bars.

Figure 6B:
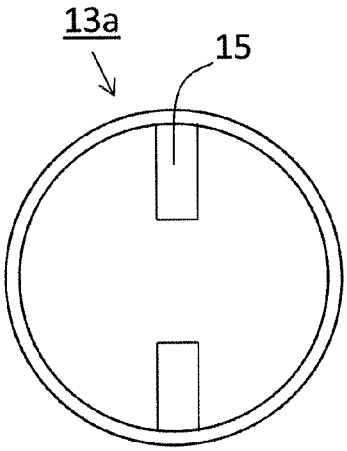

FIG. 6*b* illustrates a stator configuration that may be used together with a rotor configuration according to FIG. 6*a*. The stator protrusions 15 may have a radial extension limited only by the radial extension of the rotor shaft 11*a*, i.e. the protrusions may extend to a position in close vicinity of the rotor shaft.

Figure 6C:
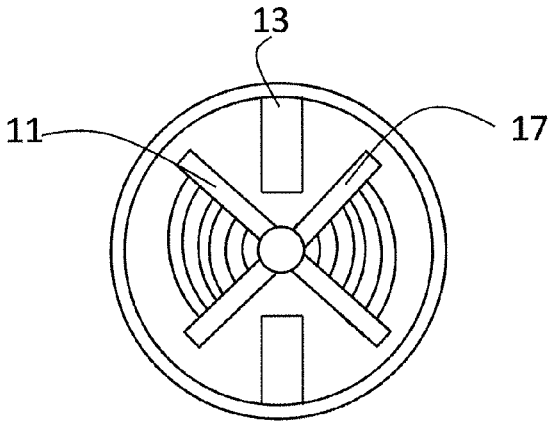

FIG. 6*c* illustrates the rotor body 11*b* in connection with the stator body 13*a*. Upon removal/insertion of the rotor or stator body, it is possible for the stator and rotor bodies to pass each other since the protrusions 15 of the stator will fit into the empty spaces between the rotor bars 17.

For embodiments where several stator and rotor bodies are involved, the puzzle configuration must be such that the removal of all rotor or all stator bodies past all stator or rotor bodies, respectively, is enabled. This may for example be accomplished by after passing on rotor or stator body, turning the part to be removed (rotor/stator) to enable passing the next rotor/stator body.

Turning to the embodiment as illustrated in FIG. 2, in a preferred embodiment where the rotor is arranged to be removable, this could mean that the first rotor body 11*b* is adapted to be able to pass the first stator body 13*a* and the second rotor body 11*c* adapted to be able to pass the second stator body 13*b*. Upon removal, after passing the respective stator bodies, the rotor 11 is then turned, the first rotor body 11*b* being adapted to pass the second stator body in the turned position. As can be readily understood by a person skilled in the art, there are a number of possibilities how to enable such a configuration. However, it is advantageous to provide the easiest possible "back-pull-out" configuration, i.e. a configuration such that the rotor may be removed from the mixing apparatus just by pulling it straight out of the apparatus.

Although the invention has been described with reference to specific illustrated embodiments, it is emphasized that it also covers equivalents to the disclosed features, as well as changes and variants obvious to a man skilled in the art, and the scope of the invention is only limited by the appended claims.

The invention claimed is:

1. A mixing unit for use in a mixing apparatus for mixing treatment media in liquid or gaseous state into a fiber suspension, which apparatus comprises a housing defining a mixing chamber, a first inlet for feeding a fiber suspension to the mixing chamber, in a flow direction F, a second inlet for feeding treatment media into the mixing chamber, a drive device, a drive shaft connected to said drive device for rotation of the drive shaft in operation, and an outlet for discharging the mixture of fiber suspension and treatment media, said mixing unit adapted to be installed in the mixing apparatus and comprising a rotor comprising a rotor shaft being adapted to be connected to the drive shaft for, in operation, simultaneous rotation with the drive shaft, at least two rotor bodies on the rotor shaft, each having a radial extension, the at least two rotor bodies being arranged to be axially separated from each other along the rotor shaft, each of said at least two rotor bodies including a plurality of rotor bars extending radially from said rotor shaft and a plurality of flow restraining discs comprising concentric rings interconnected by said plurality of rotor bars, a stator comprising at least one stator body arranged to be placed, as seen in the axial direction of the rotor shaft axis, between the at least two rotor bodies, the at least two rotor bodies and the at least one stator body being adapted to interact to produce a turbulent zone in between them so as to form multiple mixing zones within the mixing chamber, the respective configuration of the at least two rotor bodies and at least one stator body in their radial extension adapted to enable insertion and/or removal of (1) at least one of the at least two rotor bodies past said at least one stator body or (2) the at least one stator body past the at least two rotor bodies, wherein said plurality of concentric rings comprises a plurality of interrupted concentric ring portions.

2. The mixing unit according to claim 1, wherein a first of said at least one stator body is arranged, as seen in the flow direction F of the fiber suspension, after a first of said at least two rotor bodies, the first of said at least one stator body comprising a number of protrusions substantially evenly placed around the circumference of the first of the at least one stator body, the protrusions having an extension radially inwards, and where the first of the at least one stator body is followed by a second of said at least two rotor bodies.

3. The mixing unit according to claim 2, wherein said at least two rotor bodies comprise a plurality of rotor bodies with spaces therebetween extending radially from said rotor shaft and wherein the protrusions of the first of said at least one stator body are placed around the circumference of the stator in such a way that they may fit into the spaces in between the rotor bars of at least one of the at least two rotor bodies, upon insertion/removal of the rotor or the stator.

4. The mixing unit according to claim 1, wherein the at least one stator body is adapted to be mounted through the discharge outlet of the mixing apparatus.

5. The mixing unit according to claim 1, including a terminal stator body arranged after, as seen in the flow direction F of the fiber suspension, a second of said at least two rotor bodies.

6. The mixing unit according to claim 5, wherein the stator includes a common stator part, and the at least one stator body and the terminal stator body are arranged on the common stator part.

7. The mixing unit according to claim 6, wherein the common stator part is adapted to be connected to the housing at the discharge outlet.

8. The mixing unit according to claim 1, wherein the stator comprises the second inlet for feeding treatment media into the mixing chamber.

9. The mixing unit according to claim 1, wherein each of said at least one stator bodies is adapted to be mounted to the housing of the mixing apparatus by means of a separate flange, the flange forming a part of a wall defining the mixing chamber.

10. A mixing apparatus for mixing treatment media in liquid or gaseous state into a fiber suspension, which apparatus comprises a housing defining a mixing chamber, a first inlet for feeding a fiber suspension to the mixing chamber, a second inlet for feeding treatment media into the mixing chamber, a drive device, a drive shaft connected to said drive device for rotation of the drive shaft in operation for mixing said fiber suspension with said treatment media and an outlet for discharging the mixture of fiber suspension and treatment media, the mixing apparatus comprising the mixing unit according to claim 1.

11. The mixing apparatus according to claim 10, wherein the second inlet for treatment media comprises at least two distribution pipes extending in the axial direction into the mixing chamber to a position before a first of said at least two rotor bodies.

12. The mixing unit according to claim 1, wherein said plurality of concentric rings includes an outermost concentric ring disposed at a location which permits said at least one stator body to pass said outermost concentric ring.

* * * * *